US005613915A

United States Patent [19]

Van Alen, Jr.

[11] Patent Number: 5,613,915

[45] Date of Patent: Mar. 25, 1997

[54] VARIABLE RESISTANCE GOLF TRAINING DEVICE

[76] Inventor: William L. Van Alen, Jr., 975 Delchester Rd., Newtown Square, Pa. 19073

[21] Appl. No.: 615,002

[22] Filed: Mar. 12, 1996

[51] Int. Cl.[6] ..... A63B 69/36

[52] U.S. Cl. ..... 473/228; 482/109

[58] Field of Search ..... 473/228, 256; 482/109, 111

[56] References Cited

U.S. PATENT DOCUMENTS

| | | | |
|---|---|---|---|
| 3,606,340 | 2/1970 | Tiller . | |
| 3,829,102 | 8/1974 | Harrison | 473/228 |
| 4,907,800 | 3/1990 | Passemaneck et al. . | |
| 5,002,275 | 3/1991 | Beutler et al. | 473/228 |
| 5,100,148 | 3/1992 | Smith | 473/228 |
| 5,310,188 | 5/1994 | Hernberg . | |
| 5,335,918 | 8/1994 | Rupnik et al. | 473/228 |
| 5,362,059 | 11/1994 | Grossman | 473/228 |
| 5,415,406 | 5/1995 | Reichenbach et al. | 473/228 |

FOREIGN PATENT DOCUMENTS

| | | |
|---|---|---|
| 2060405 | 5/1981 | United Kingdom . |

*Primary Examiner*—George J. Marlo
*Attorney, Agent, or Firm*—Dann, Dorfman, Herrell and Skillman, P.C.

[57] ABSTRACT

A variable resistance golf training device is disclosed. The device incorporates a frame attached to the end of a shaft. A plurality of vanes are rotatably mounted within the frame in a parallel spaced array. The vanes are incrementally operable between open and closed positions to incrementally vary the wind resistance of the device.

14 Claims, 3 Drawing Sheets

VARIABLE RESISTANCE GOLF TRAINING DEVICE

FIELD OF THE INVENTION

The present invention relates to the field of golf training devices. Specifically, the present invention relates to a golf training device that utilizes vanes to create wind resistance. More specifically, the present invention relates to a golf training device that provides a plurality of vanes operable by a single operator to simultaneously vary the position of the vanes to vary the wind resistance of the device.

BACKGROUND OF THE INVENTION

Many devices have been developed to train and strengthen the muscles used in a golf swing. Typically, the known devices utilize weight and/or wind resistance. For example, the prior art discloses several devices that include a drag component and a golf club shaft or similar component. The drag component increases the wind resistance so that when a person practices his or her golf swing with the device, the muscles used in the swing are strengthened. Such devices are disclosed by Hernberg 5,310,188, Rupnik et al. 5,335,918 and Reichenbach et al. 5,415,406.

The Rupnik et al. '918 device utilizes an airfoil or wing that is connected to a golf club shaft. Similarly, the Reichenbach et al. '406 device utilizes an air-resistant blade connected to a golf club shaft. The Hernberg '188 device differs in that it utilizes a drag component that has four orthogonal fins or wings to increase the wind resistance. However, each of these devices suffers from the same shortcoming, namely, that the wind-resistance of the device cannot be varied to meet the particular needs of the individual using the device.

Smith 5,100,148 attempted to overcome this shortcoming by providing variable resistance. Smith '148 discloses a device having a shaft and a pair of wing assemblies. Each wing assembly comprises a plurality of removable wings. The wind resistance of the device can be varied by increasing or decreasing the number of wings in the wing assembly.

The difficulty with the Smith '148 device is that varying the wind resistance is cumbersome, requiring disassembly and reassembly of the device. Further, the Smith '148 device does not readily allow for a full-range of adjustment, because the wind-resistance can only be varied by the amount of wind-resistance of an individual wing. To obtain a full range of adjustment, either the wings must be quite small or a variety of wing sizes must be utilized. Either option overly complicates the process of varying the wind resistance.

Furthermore, in each of the foregoing devices, the wings extend along the shaft axis and project radially from the shaft axis. The result is that the wind resistance may tend to rotate the shaft and affect the person's grip on the shaft.

SUMMARY OF THE INVENTION

With the foregoing in mind, the present invention provides a novel golf training device, which has improved means for conveniently providing a full-range of variable wind resistance. In this way, the wind-resistance of the device can be readily adjusted to meet the needs of each person using the device.

The present invention provides a simplified golf training device having a hollow frame fixedly connected to the end of an elongated shaft. Rotatably connected to the frame are a plurality of longitudinally elongated vanes arranged in a spaced parallel array within the frame. The vanes are incrementally operable between an open and a closed position to vary the wind resistance of the device. The present invention also provides for an operator that allows the vanes to be rotated simultaneously.

BRIEF DESCRIPTION OF THE DRAWINGS

All of the objectives of the present invention are more fully set forth hereinafter with reference to the accompanying drawings, wherein.

DESCRIPTION OF THE PREFERRED EMBODIMENTS

Figure 1:
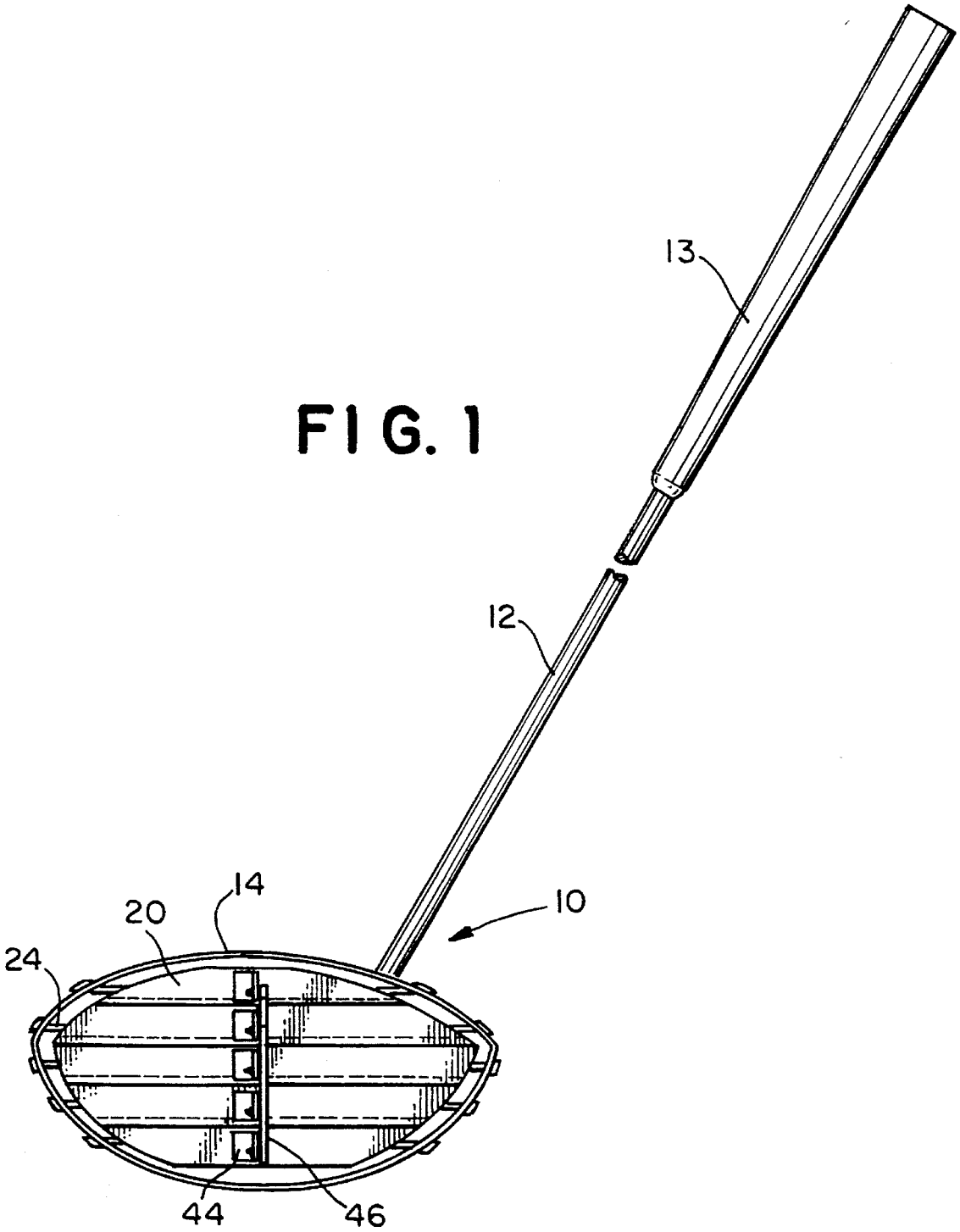
FIG. 1 is a front elevational view of a variable resistance golf training device manifesting aspects of the invention, with the vanes adjusted to the closed position.
Figure 2:
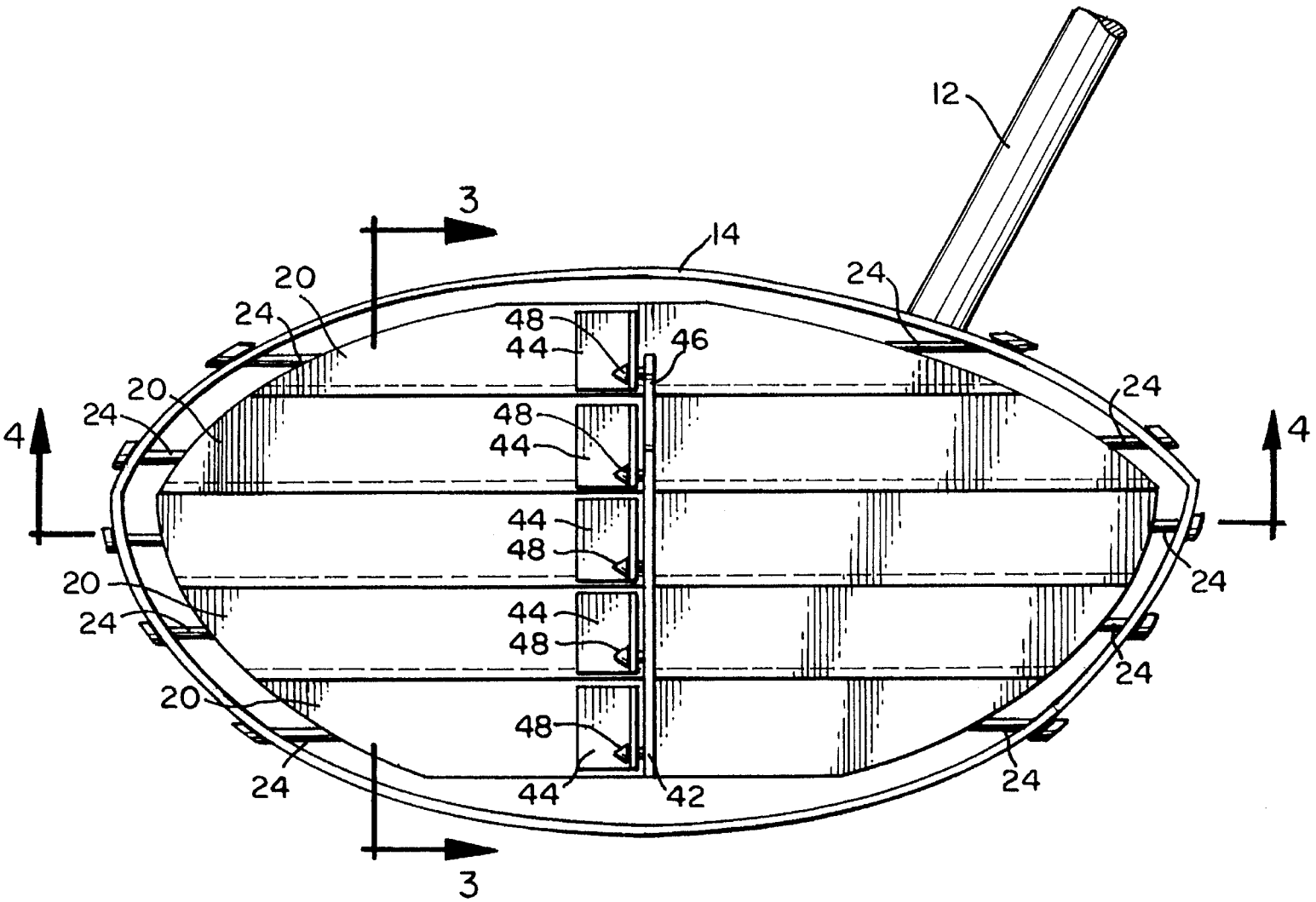
FIG. 2 is an enlarged fragmentary view of the head of the device illustrated in FIG. 1.

Referring now to the drawings generally and FIGS. 1 and 2 specifically, a variable resistance golf training device 10 is illustrated. The training device has a frame 14 mounted on a shaft 12. A plurality of vanes 20 are rotatably mounted within the frame 14 and are operated by a link bar 42.

The shaft 12 is preferably tubular and in the present instance simulates a metallic golf club shaft, including a golf club grip 13 as shown in FIG. 1. The frame 14 is fixedly attached to the distal end of the shaft. The frame 14 can be attached in any number of ways, such as by welding, by adhesive, or by interference fit. In the present instance, however, the frame is welded to the shaft.

As shown in FIG. 2, the frame is a ring having a generally elliptical circumference to resemble the head of a golf club. The elliptical frame 14 does not provide significant wind resistance. To provide wind resistance, a plurality of vanes 20 are mounted in the frame 14. The vanes 20 are longitudinally elongated, and are generally planar. Preferably, each vane has two generally linear and parallel, longitudinally elongated sides. Each vane also has two ends extending between and transverse to the elongated sides and curving to generally conform to the shape of the elliptical frame 14.

A series of mounting pins 24 connects the vanes 20 to the frame 14. The mounting pins 24 are aligned with the longitudinal axis of each associated respective vane, and are fixedly connected to each vane, so that a mounting pin projects from each end of each vane. Preferably, the mounting pins are integral parts of the vanes 20.

The elliptical frame 14 has a series of sockets corresponding to the mounting pins 24. Each mounting pin extends through a socket in the elliptical frame. The mounting pins are cylindrical, so that the mounting pins are rotatable within the sockets in the frame to allow each vane to rotate on its longitudinal axis. The end of each mounting pin adjacent the frame is mushroomed to hold each mounting pin captive within the frame, while allowing each mounting pin to rotate within the frame. The longitudinal axes of the vanes 20 are arranged in a spaced parallel array within the frame. The spacing between the axes of adjacent vanes is less than the width of the vanes so that the longitudinally extended sides of adjacent vanes are generally parallel and overlapping when the vanes are in the closed position. In the present instance, the longitudinal rotary axis of each vane is approximately midway between the longitudinal sides of the vane, as shown in the drawings.

Preferably, the vanes 20 are mounted within the frame 14 so that the longitudinal axes of the vanes 20 are generally parallel to the surface of the ground when the shaft is held in the normal position used to address a golf ball. Stated mathematically, the angle between the axis of the shaft and the longitudinal pivotal axes of the vanes corresponds to the angle which the shaft of a conventional golf club assumes relative to the ground when addressing a ball.

The vanes 20 are incrementally adjustable between an open position and a closed position. In the closed position, the vanes are disposed parallel to the plane of the frame. In the closed position, adjacent vanes overlap, providing the maximum wind resistance of the device. In the open position, the vanes are rotated so that the vanes are generally normal to the position of the vanes in the closed position. In the open position, adjacent vanes generally do not overlap, providing the minimum wind resistance of the device.

As detailed above, the axis of rotation of the vanes is preferably at an angle to the shaft axis. Therefore, the tendency of the vanes to rotate from the drag of the vanes will not tend to rotate the shaft.

Figure 4:
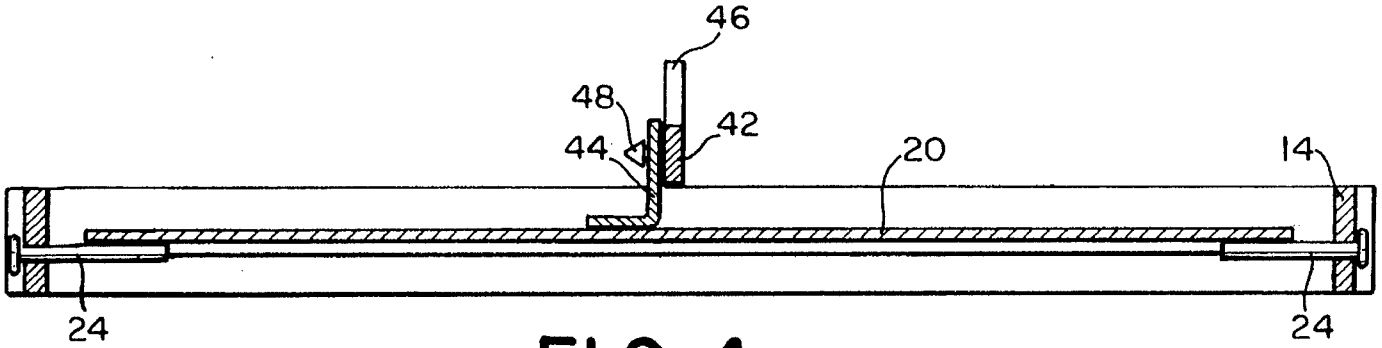
FIG. 4 is a cross-sectional view taken along line 4—4 of FIG. 2, with the vanes adjusted to the closed position.
Figure 3:
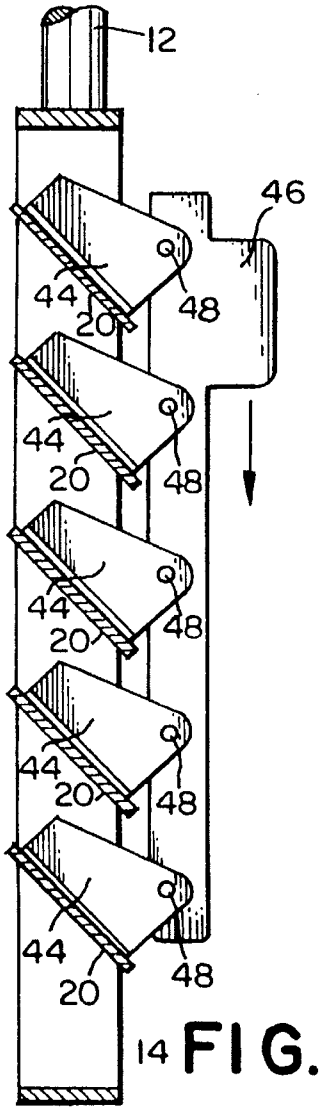
FIG. 3 is a transverse cross-sectional view of the device taken along line 3—3 of FIG. 2, with the vanes adjusted to a partially closed position.

As shown in FIGS. 2–4, a link bar 42 incrementally rotates the vanes 20 simultaneously between the open and closed positions. The link bar is connected to a plurality of mounting brackets 44, which are connected to the vanes. As illustrated in FIG. 4, each mounting bracket is preferably L-shaped, having one leg connected flush against the associated vane 20 and a perpendicular web pivotally connected to the link bar 42. The number of mounting brackets corresponds to the number of vanes, and each mounting bracket is connected to its associated vane.

The link bar 42 is rotatably connected to each mounting bracket 44, preferably via a series of cylindrical connecting studs 48, which are integral portions of the link bar. Each stud projects through a hole in one of the mounting brackets, and each stud is connected to a different mounting bracket. The connecting studs 48 are connected to the mounting bracket 44 by mushrooming the ends of the studs 48 adjacent the respective mounting brackets 44. Mushrooming the ends holds the connecting stud captive, while allowing the stud to rotate within the mounting brackets. Connected in this way, each mounting bracket 44 and therefore each vane 20 is pivotally connected to the link bar 42.

The link bar 42 is operated manually. By grasping an integral handle portion 46 of the link bar 42 and sliding the link bar, the vanes 20 can be simultaneously, incrementally rotated between open and closed positions. As shown in FIG. 3, by sliding the link bar handle 46 from left to right in the direction of the arrow, the vanes 20 are rotated toward the closed position.

The device is operated by grasping the grip 13, preferably with both hands. While standing as one would typically address a golf ball, the device is grasped so that the frame 14 is generally parallel with the user's feet. The device is swung along an arcuate path in the same way that a typical golf club is swung, starting with an upward backswing. At the end of the backswing, the frame 14 is preferably parallel with the swing path. As the device swings downwardly, the action of a typical golf swing twists the frame transverse the swing path. The lowest point of the swing path typically is generally the same as the point at which the backswing began. At the lowest point of the swing, the frame is generally perpendicular to the swing path. As the swing proceeds past the lowest point, the device is swung in an upward followthrough. The actions of a typical golf swing continue to rotate the frame transverse the swing path, so that the frame is generally parallel to the swing path at the end of the followthrough.

In the open position, the vanes 20 are generally parallel to the swing path of the device at the lowest point of the swing path. Therefore, in the open position, the resistance of the device 10 is minimized during the portions of the swing in which the frame 14 is transverse the swing path of the device. By sliding the link bar 42, the vanes can be rotated to the closed position. In the closed position, the vanes 20 are generally perpendicular to the swing path of the device at the lowest point of the swing path. Therefore, in the closed position, the wind resistance of the device 10 is maximized during the portions of the swing in which the frame 14 is transverse the swing path of the device. By sliding the link bar 42, the vanes can be rotated to a partially closed position to provide resistance between the maximum and minimum resistance of the closed and open positions.

While particular embodiments of the present invention have been herein illustrated and described, it is not intended to limit the invention to such disclosure, but changes and modifications may be made therein and thereto within the scope of the following claims.

I claim:

1. A variable resistance golf training device comprising:

an elongated shaft;

a frame fixedly connected to the distal end of said shaft;

a plurality of longitudinally elongated vanes rotatably mounted to said frame, wherein said vanes are arranged in a spaced parallel array within the frame, and said vanes are incrementally operable between an open position and a closed position to incrementally vary the wind resistance of said golf training device.

2. The golf training device of claim 1 wherein each of said vanes has two ends and each vane further comprises two mounting pins projecting from said two ends, one of said mounting pins projecting from one of said two ends and the second mounting pin projecting from the other of said two ends, wherein said mounting pins are rotatably mounted to said frame.

3. The golf training device of claim 1 wherein each of said vanes is mounted to said frame along a longitudinal axis of the vane, and the spacing between the mounting axis of adjacent vanes is less than the width of the adjacent vanes, so that adjacent vanes overlap when said adjacent vanes are in the closed position.

4. The golf training device of claim 1 further comprising an operator incrementally operable between open and closed positions corresponding to the position of said vanes, wherein operation of said operator simultaneously, incrementally rotates said vanes.

5. The golf training device of claim 4 wherein said operator is connected to each of said vanes.

6. The golf training device of claim 4 further comprising a plurality of mounting brackets, wherein one of said mounting brackets projects from each of said vanes, and said operator is connected to each of said mounting brackets.

7. The golf training device of claim 6 wherein said operator is rotatably connected to each of said mounting brackets.

8. A variable resistance golf training device comprising:

an elongated shaft;

a frame fixedly connected to the distal end of said shaft;

a plurality of longitudinally elongated vanes rotatably mounted within said frame, wherein said vanes are arranged in a spaced parallel array within the frame, and said vanes are incrementally operable between an open position and a closed position to incrementally vary the wind resistance of said golf training device;

said vanes being mounted within said frame so that the axes of rotation of said vanes are at an angle to the axis of said shaft, and the angle between said axes of rotation and said shaft axis corresponds to the angle that the shaft of a conventional golf club assumes relative to the ground when addressing a ball.

9. The golf training device of claim 8 wherein each of said vanes has two ends and each vane further comprises two mounting pins projecting from said two ends, one of said mounting pins projecting from one of said two ends and the second mounting pin projecting from the other of said two ends, wherein said mounting pins are rotatably mounted to said frame.

10. The golf training device of claim 8 wherein each of said vanes is mounted to said frame along a longitudinal axis of the vane, and the spacing between the mounting axis of adjacent vanes is less than the width of the adjacent vanes, so that adjacent vanes overlap when said adjacent vanes are in the closed position.

11. The golf training device of claim 8 further comprising an operator incrementally operable between open and closed positions corresponding to the position of said vanes, wherein operation of said operator simultaneously, incrementally rotates said vanes.

12. The golf training device of claim 11 wherein said operator is connected to each of said vanes.

13. The golf training device of claim 11 further comprising a plurality of mounting brackets, wherein one of said mounting brackets projects from each of said vanes, and said operator is connected to each of said mounting brackets.

14. The golf training device of claim 13 wherein said operator is rotatably connected to each of said mounting brackets.

* * * * *